US006182324B1

(12) United States Patent
Pagliuzza et al.

(10) Patent No.: US 6,182,324 B1
(45) Date of Patent: Feb. 6, 2001

(54) GOLF CLUB GROOVE CLEANING TOOL

(76) Inventors: Mario Pagliuzza, 21450 Old Barrington Rd., Barrington, IL (US) 60010; James R. Novak, 3516 Elliot La., Naperville, IL (US) 60564; Karel Hauk, 25580 Williams Rd., Warrenville, IL (US) 60555; Michael R. Kalamaras, 17 Loraine Ct., Cary, IL (US) 60013

( * ) Notice: Under 35 U.S.C. 154(b), the term of this patent shall be extended for 0 days.

(21) Appl. No.: 09/275,155

(22) Filed: Mar. 24, 1999

(51) Int. Cl.[7] ..... A63B 57/00; A47L 25/00

(52) U.S. Cl. ..... 15/236.09; 15/236.01; 30/169; D32/48; D32/49

(58) Field of Search ..... 15/236.01, 236.05–236.09; 30/162, 169, 357; D32/46–49

(56) References Cited

U.S. PATENT DOCUMENTS

| | | | | |
|---|---|---|---|---|
| D. 212,712 | * | 11/1968 | Godfrey | D32/49 X |
| 1,195,297 | * | 8/1916 | Vlchek | 15/236.05 X |
| 1,488,648 | * | 4/1924 | Redington | 30/169 |
| 2,120,483 | | 6/1938 | Burger | 451/557 |
| 2,344,880 | | 3/1944 | Johnson | 451/557 |
| 2,682,072 | * | 6/1954 | Green | 15/236.01 X |
| 2,857,608 | * | 10/1958 | Schwartz | 15/236.01 |
| 2,981,964 | * | 5/1961 | Downing | 15/236.05 X |
| 3,047,896 | * | 8/1962 | Gunderson | 15/236.08 X |
| 3,155,997 | * | 11/1964 | Gallagher | 15/236.01 X |
| 3,267,506 | * | 8/1966 | Van Patten | 15/236.07 |
| 4,086,678 | * | 5/1978 | Torr | 15/236.09 X |
| 4,845,901 | | 7/1989 | Hamlin | 451/523 |
| 4,908,899 | * | 3/1990 | Killen | 15/236.09 X |
| 4,930,177 | * | 6/1990 | Rastutis | 15/236.05 X |
| 5,007,129 | * | 4/1991 | Hainey | 15/236.08 |
| 5,121,519 | * | 6/1992 | Haugom | 15/236.08 X |
| 5,185,967 | | 2/1993 | Cutsforth | 451/49 |
| 5,195,278 | | 3/1993 | Grove | 451/524 |
| 5,437,074 | * | 8/1995 | White et al. | 15/236.05 X |
| 5,509,205 | * | 4/1996 | Ragland, III | 30/162 |
| 5,555,592 | * | 9/1996 | Crego | 15/236.01 X |
| 5,720,105 | * | 2/1998 | Gates | 30/162 X |
| 5,819,355 | * | 10/1998 | Wu | 15/236.01 X |

FOREIGN PATENT DOCUMENTS

| | | | | |
|---|---|---|---|---|
| 2704019 | * | 8/1978 | (DE) | 30/162 |

* cited by examiner

*Primary Examiner*—Mark Spisich
(74) *Attorney, Agent, or Firm*—Marshall, O'Toole, Gerstein, Murray & Borun

(57) ABSTRACT

A device for removing peened material from within a groove on the face of a golf club and for restoring the groove to a desired shape is disclosed. The groove cleaning device includes a handle and a blade. The blade includes a body mounted to the handle and further includes a protruding portion terminating in a tip. A portion of the tip defines a cutting portion having a cross-section generally conforming to the desired groove shape. Accordingly, in response to movement of the blade along the groove, the cutting portion removes the peened material from the groove and thereby restores the groove to the desired shape.

15 Claims, 5 Drawing Sheets

GOLF CLUB GROOVE CLEANING TOOL

FIELD OF THE INVENTION

The present invention relates to a tool for reconditioning the grooves on the face of a golf club.

BACKGROUND OF THE INVENTION

In the game of golf, a very important element, and also one of the most difficult elements to achieve and master, is the element of control of the golf ball. Many factors combine to affect a player's control, such as the speed, angle, and consistency of the player's swing, the type of ball chosen by the player, as well as the condition of the face of the club used to hit the golf ball.

Golf clubs have angled faces in order to project a golf ball upwardly upon impact, with different clubs having different angles depending on the amount of loft desired. The face of a golf club also has a series of cuts or grooves that extend transversely across a portion of the club face. When the player hits a golf ball, these grooves, along with the angle of the club, impart rotation to the golf ball. As is well known, as more rotation is imparted to the ball, the player's control over the flight of the ball is improved. A number of variables combine to affect the amount of spin imparted to the golf ball, such as the number of grooves, the size and shape of the grooves, as well as the overall condition and cleanliness of the club face. The size of the grooves, i.e., the width and depth of the grooves, is controlled by rules developed by the United States Golf Association.

Unfortunately, the condition of the grooves tends to deteriorate with use of the golf club. Dirt and other debris (from too many divots, for example) can easily fill in the grooves, thus minimizing or eliminating the effectiveness of the grooves. Such dirt and other debris can be removed relatively easily by simply cleaning the club face.

However, during the life of the club, the repetitive impact with a golf ball tends to permanently alter the shape of the grooves. The repetitive impact of the club face against the golf ball causes portions of the club face adjacent to the grooves to "peen over" into the groove. This peening both narrows the width of the groove and effectively reduces the depth of the groove, thus degrading the performance of the golf club.

Accordingly, there exists a need for a tool that would recondition the grooves on the face of the golf club to their original condition, thereby restoring the golf club to its original effectiveness.

SUMMARY OF THE INVENTION

According to one aspect of the invention, a device for removing peened material from within a groove on the face of a golf club, and for restoring the groove to a desired shape, includes a handle and a blade. The blade includes a body mounted to the handle and further includes a protruding portion terminating in a tip. A portion of the tip defines a cutting portion having a cross-section generally conforming to the desired groove shape. Accordingly, in response to movement of the blade along the groove, the cutting portion removes the peened material from the groove and thereby restores the groove to the desired shape.

Preferably, the blade is removably mounted to the handle, and the handle includes a pair of joinable halves that enclose an interior space. A mounting portion of the blade is adapted to be secured within the interior space, and the blade mounting portion preferably includes an edge having one or more slots which engage an interior lip on one of the halves in order to secure the blade to the handle.

The tip includes a leading edge which comprises the cutting portion, and further includes a trailing edge. The leading edge includes a bottom edge and a pair of side edges. Preferably, the bottom edge is 0.035 inches wide, which conforms to USGA rules for groove width, while the side edges are preferably 0.020 inches long, which conforms to USGA rules for groove depth, thus establishing the desired cross-sectional shape of the grooves. Alternatively, the leading edge may include a pair of side edges converging at a point, which sides are adapted to conform to a "V" shaped groove. The size of a "V" shaped groove also conforms to USGA rules.

The trailing edge includes a curved portion terminating at a bottom edge of the tip, whereas the leading edge of the blade is generally straight or linear in the region of the tip. Preferably, the blade is mounted to the handle on a slide assembly, which permits the blade to be retracted into the handle.

According to another aspect of the invention, a device for restoring a groove on the face of a golf club to a desired shape by removing unwanted material therefrom comprises a handle and a blade. The blade includes a body and a protruding tip, with the body being mounted to the handle. A portion of the protruding tip defines cutting means for cutting the unwanted material from within the groove. The cutting means defines a cross-section corresponding to the desired groove shape, with the cutting means being responsive to movement of the protruding tip along a longitudinal axis of the groove to thereby restore the groove to the desired shape.

According to yet another aspect of the invention, a device for removing debris from within a groove on the face of a golf club and for restoring the groove to a desired shape comprises a handle having a pair of joinable halves defining an interior cavity, and a planar blade. The blade includes a body having a mounting portion adjustably mounted within the handle interior cavity, and the blade further includes a leading edge and a trailing edge converging at a cutting tip protruding away from the body. The cutting tip is defined by a pair of side edges and a bottom edge, and the cutting tip has a cross-section generally conforming to the desired groove shape. Thus, in response to movement of the blade along the groove the cutting tip removes the debris from the groove, thereby restoring the groove to the desired shape.

These and other advantages and features of the invention will become readily apparent to those skilled in the art upon a reading of the following description.

BRIEF DESCRIPTION OF THE DRAWINGS

In the course of the following detailed description, reference will be made to the attached drawings wherein like reference numerals identify like parts and wherein.

DETAILED DESCRIPTION OF THE PREFERRED EMBODIMENT

The embodiment described herein is not intended to limit the scope of the invention to the precise form disclosed. The embodiment has been chosen and described in order to explain the principles of the invention and its practical use in order to enable others skilled in the art to follow its teachings.

Figure 5:
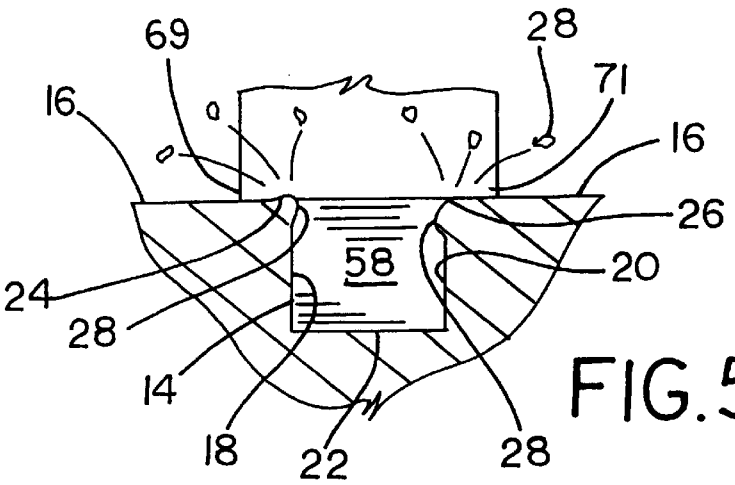
FIG. 5 is an enlarged fragmentary cross-sectional similar to FIG. 4 but illustrating the cutting tip being used to remove peened material from a groove on the face of a golf club.
Figure 7:
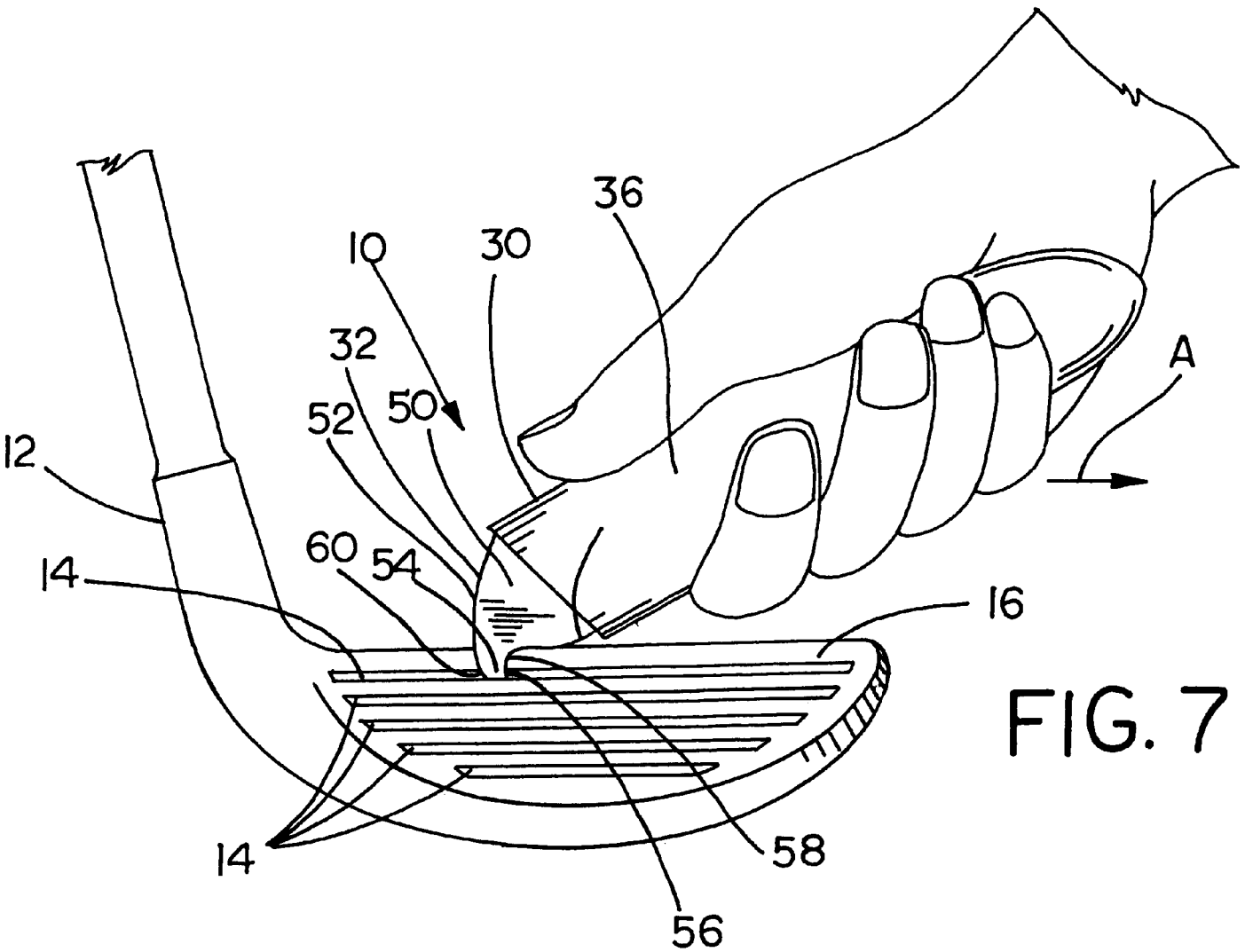
FIG. 7 is a perspective view of the present golf club groove reconditioning tool shown being used on the face of a golf club.

Referring now to the drawings, a golf club reconditioning tool constructed in accordance with the teachings of the present invention is generally referred to by the reference numeral 10. As shown in FIG. 5 and FIG. 7, the tool 10 is adapted for reconditioning a golf club 12 having a plurality of grooves 14 extending across a face 16 thereof.

Figure 6:
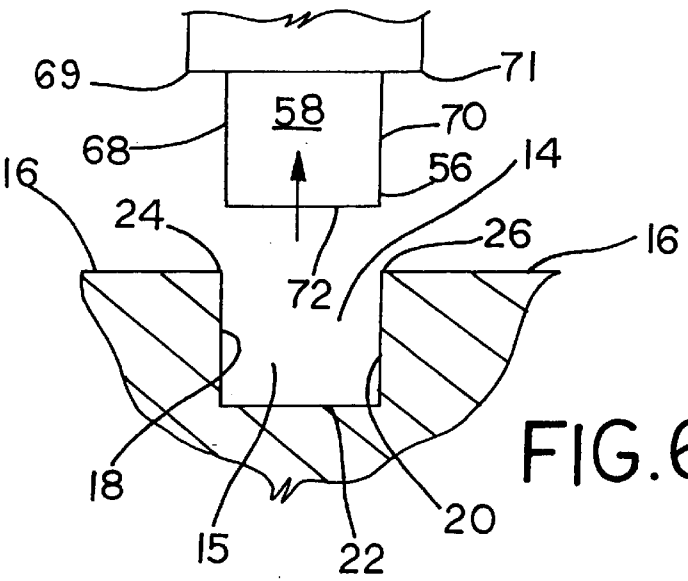
FIG. 6 is an enlarged fragmentary cross-sectional view similar to FIG. 5 but showing the groove in a restored condition.

As shown in FIGS. 5 and 6, each groove 14 includes a cross section 15 defined by pair of side walls 18, 20 and an interconnecting bottom wall 22. Each side wall 18, 20 defines a corner 24, 26, respectively, with an adjacent portion of the club face 16. It will be understood by those of skill in the art that, during normal use of the golf club 12, portions of the corners 24, 26 will eventually be deformed due to impact with a golf ball (not shown), such that the deformed material forms debris 28 which enters or otherwise extends into the groove 14. It will also be understood that each groove 14 extends longitudinally across a portion of the club face 16, i.e. each groove 14 extends between the heel of the club face and the toe of the club face.

Figure 1:
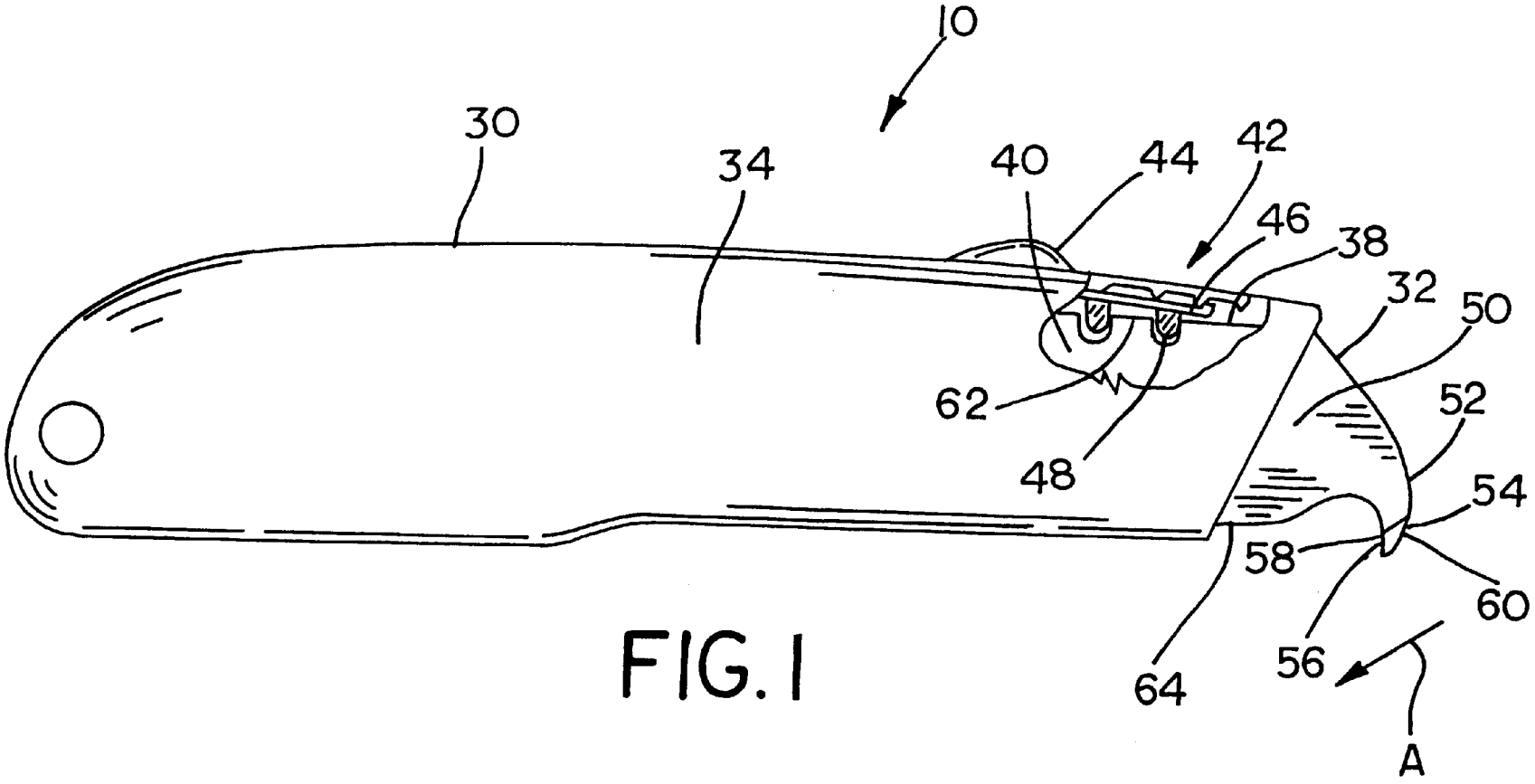
FIG. 1 is an elevational view of a golf club groove reconditioning tool constructed in accordance with the teachings of the present invention.

Referring now to FIGS. 1 and 7, the tool 10 includes a handle 30 and a blade 32. A can be seen in FIG. 7, the handle 30 is preferably separable into a pair of halves 34, 36. The halves 34, 36 cooperate to define an internal cavity 38 adapted to receive a rear portion 40 of the blade 32. The handle 30 preferably includes a slide assembly 42 including an actuating button 44 and a locking slide assembly 46 having one or more protrusions 48 which engage the blade 32 in the manner explained below.

Figure 2:
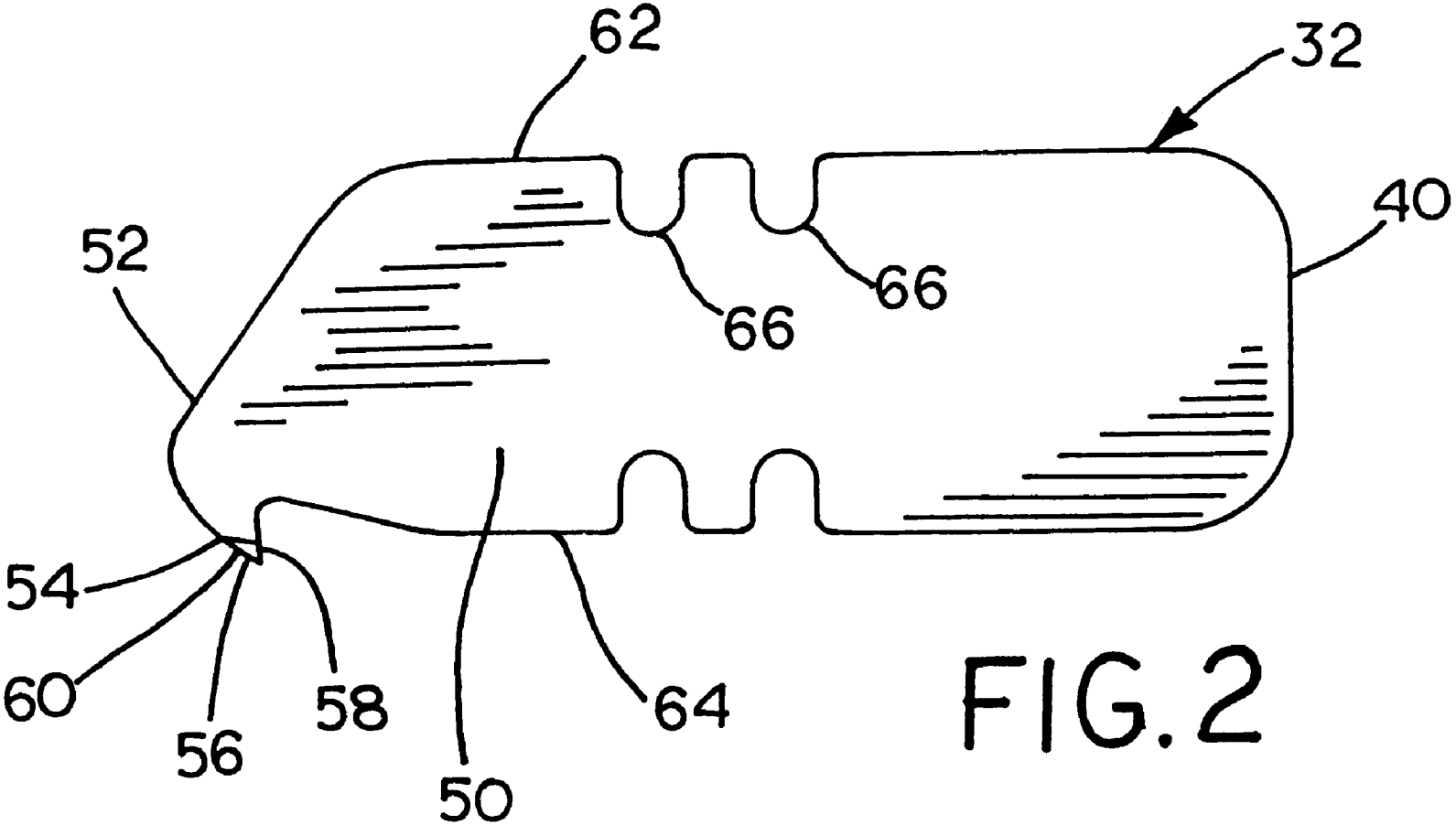
FIG. 2 is an enlarged view of the cutting blade.
Figure 3:
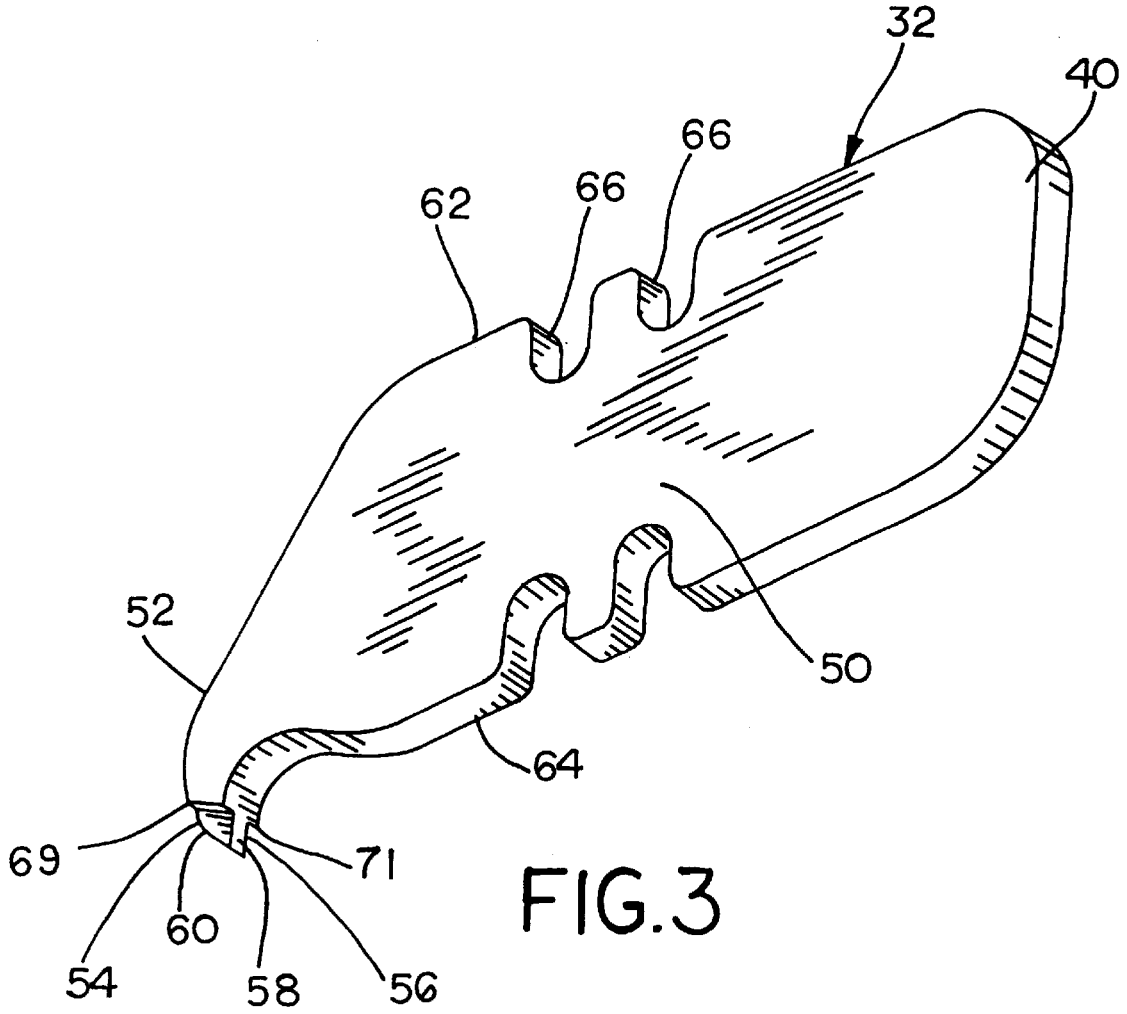
FIG. 3 is an enlarged perspective view of the blade shown in FIG. 2.

As shown in FIGS. 2 and 3, the blade 32 includes a generally planar body 50. The blade 32 also includes a protruding portion 52 which terminates in a tip 54 having a cutting portion 56. The cutting portion 56 generally is generally defined by a leading edge 58, and the tip 54 also includes a trailing edge 60. Preferably, the trailing edge 60 is curved. It will be noted that the leading edge 58 and the trailing edge 60 are defined in relation to the preferred direction of using the tool 10 as will be outlined in greater detail below.

The blade 32 includes a pair of interconnecting side edges 62, 64, which extend generally between the rear portion 40 and the protruding portion 52. The side edge 62 includes a pair of notches or slots 66, which are adapted to be engaged by the protrusions 48 on the slide assembly 42 of the handle 30 in order to secure the rear portion 40 of the blade 32 within the cavity 38.

Figure 4A:
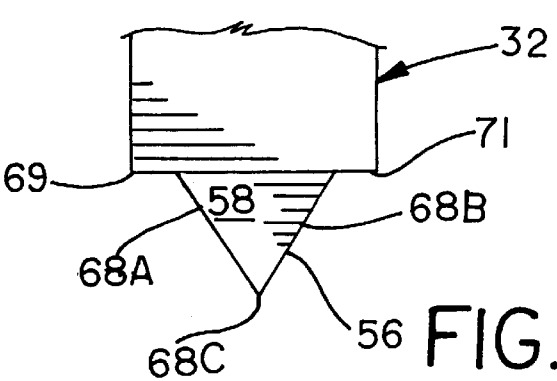
FIG. 4A is an enlarged fragmentary cross-sectional view taken along lines 4—4 of FIG. 3 and illustrating a different embodiment for the cross-section of the cutting tip.
Figure 4:
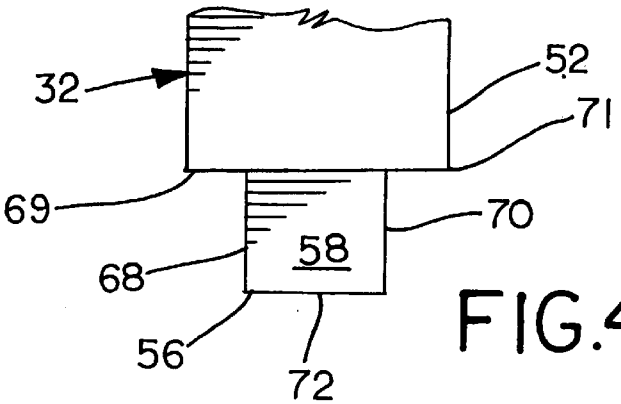
FIG. 4 is an enlarged fragmentary cross-sectional view taken along lines 4—4 of FIG. 3 and illustrating the cross-section of the cutting tip.

Referring now to FIGS. 4, 5 and 6, the cross-sectional shape of the leading edge 58 is defined by a pair of side walls or edges 68, 70 and an interconnecting bottom wall or edge 72. Preferably, the side edges are 0.035 inches in depth, which conforms to USGA rules of the desired depth of the groove 14, while the bottom edge is 0.020 inches, which conforms to USGA rules for the desired groove width. The desired dimension may of course be altered, although the above-given dimensions are in accordance with standards established by the United States Golf Association. A pair of shoulders 69, 71 serve to define the maximum depth of the cutting portion 58. Further, in some instances the groove 14 may have a "V" shaped cross-section, in which instance the cutting portion 58 may be defined by a pair of intersecting side edges 68*a* and 68*b* which converge at a point 68*c* as is shown in FIG. 4A.

In operation, the tool 10 is positioned adjacent to the face 16 of the golf club 12 with the blade 32 extending into the groove 14 as shown in FIG. 7. As shown in FIGS. 4 and 5, the cutting portion 56 of the tip 54 is disposed in the groove 14, such that the edges 68, 70 and 72 of the cutting portion 56 are positioned to contact any debris 28 such as peened material that extends into the groove 14.

As shown in FIGS. 1 and 7, the tool 10 is drawn across the face 16 of the club 12 in the direction generally indicated by the reference arrow "A", which is in the direction to permit the leading edge 58 to be drawn through the groove 14. By virtue of the curved trailing edge 60, the tool 10 is easily moved in the opposite direction without cutting any material. The tool is drawn through or along one or more of the grooves 14 as necessary until all unwanted debris 28 has been removed. The shoulders 69, 71 prevent the tool 10 from cutting into the groove 14 beyond the maximum desired depth as outlined above.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A device for restoring a groove on the face of a golf club to a desired shape by removing unwanted material therefrom, the device comprising:

an elongated handle; and a blade, the blade including a body and a protruding tip, the body being slidably mounted within the handle, a portion of the protruding tip having a leading edge defining cutting means for cutting the unwanted material from within the groove, the protruding tip further defining a non-cutting trailing edge, the cutting means having a cross-section corresponding to the desired groove shape, the cutting means being defined in part by a pair of opposed shoulders sized to limit the penetration of the cutting means into the groove, the cutting means being responsive to movement of the protruding tip along a longitudinal axis of the groove in a predetermined direction with the elongated handle oriented at an acute angle relative to the face of the golf club to thereby restore the groove to the desired shape.

2. The device of claim 1, wherein the blade is removably mounted to the handle.

3. The device of claim 1, wherein the handle includes a pair of joinable halves enclosing an interior space, and wherein a mounting portion of the blade is adapted to be secured within the interior space.

4. The device of claim 3, wherein the blade mounting portion includes an edge having a slot and wherein one of the halves includes an interior lip engaging the slot for securing the blade mounting portion within the interior space.

5. The device of claim 4, wherein the edge includes a plurality of slots.

6. The device of claim 1, wherein the leading edge includes a bottom edge and a pair of side edges.

7. The device of claim 6, wherein the bottom edge is 0.035 inches wide, and wherein each of the side edges is 0.020 inches deep.

8. The device of claim 1, wherein the leading edge includes a pair of side edges converging at a point.

9. The device of claim 1, wherein the trailing edge includes a curved portion terminating at a bottom edge of the protruding tip.

10. The device of claim 1, wherein the blade is mounted to the handle on a slide assembly, thereby permitting the blade to be retracted into the handle.

11. A device for removing debris from within a groove on the face of a golf club and for restoring the groove to a desired shape, the device comprising:

a handle having a pair of joinable halves defining an interior cavity; and a planar blade, the blade including a body having a mounting portion slidably mounted within the handle interior cavity, the blade further including a leading edge and a non-cutting trailing edge converging at a cutting tip protruding away from the body, the cutting tip being defined by a pair of side edges and a bottom edge, the cutting tip having a cross-section generally conforming to the desired groove shape, the cutting tip further including a pair of opposed shoulders adapted to control the penetration of the cutting tip into the groove;

whereby in response to movement of the blade along the groove the cutting portion removes the debris from the groove, thereby restoring the groove to the desired shape.

12. The device of claim 11, wherein the blade is removably mounted to the handle interior cavity.

13. The device of claim 11, wherein the blade mounting portion includes an edge having a slot and wherein one of the halves includes an interior tip engaging the slot for securing the blade mounting portion within the interior cavity.

14. The device of claim 13, wherein the edge includes a plurality of slots.

15. The device of claim 11, wherein the bottom edge is 0.035 inches wide, and wherein each of the side edges is 0.020 inches deep.

* * * * *